US012790909B2

(12) United States Patent
Vonstad

(10) Patent No.: US 12,790,909 B2
(45) Date of Patent: Nov. 10, 2026

(54) COLLECTION UNIT FOR CUTTINGS

(71) Applicant: The Coring Company AS, Mo i Rana (NO)

(72) Inventor: Frida Klæbo Vonstad, Mo i Rana (NO)

(73) Assignee: The Coring Company AS, Mo i Rana (NO)

( * ) Notice: Subject to any disclaimer, the term of this patent is extended or adjusted under 35 U.S.C. 154(b) by 0 days.

(21) Appl. No.: 18/877,279

(22) PCT Filed: Feb. 27, 2023

(86) PCT No.: PCT/NO2023/050043
§ 371 (c)(1),
(2) Date: Dec. 20, 2024

(87) PCT Pub. No.: WO2024/005641
PCT Pub. Date: Jan. 4, 2024

(65) Prior Publication Data

US 2025/0376904 A1 Dec. 11, 2025

(30) Foreign Application Priority Data

Jun. 29, 2022 (NO) ..... 20220749

(51) Int. Cl.
*E21B 27/04* (2006.01)
*E21B 7/00* (2006.01)
(Continued)

(52) U.S. Cl.
CPC ..... *E21B 27/04* (2013.01); *E21B 7/005* (2013.01); *E21B 17/10* (2013.01); *E21B 17/22* (2013.01)

(58) Field of Classification Search
CPC ..... E21B 27/04; E21B 49/02; E21B 10/02; E21B 10/04
See application file for complete search history.

(56) References Cited

U.S. PATENT DOCUMENTS 1,203,784 A * 11/1916 Richard ..... E21B 27/00 175/242
1,362,774 A 12/1920 Bunker
(Continued)

FOREIGN PATENT DOCUMENTS

CN 112855132 5/2021
DE 9016707 A 4/1992
(Continued)

OTHER PUBLICATIONS

Norwegian Search Report dated Dec. 15, 2022.
(Continued)

*Primary Examiner* — David Carroll
(74) *Attorney, Agent, or Firm* — Christian D. Abel

(57) ABSTRACT

The present invention relates to a cuttings collector for obtaining drill cuttings from subterranean wellbores, at least comprising:

a) a cuttings collector stem provided with a double helix cutterblade acting as a conveyor screw having two transport paths,
b) an external wall surrounding one of the two transport paths and a lower wall closing said one transport path at the lower end thereof,
c) the cuttings collector stem, at the upper end thereof, being provided with a top sleeve having an opening and closing arrangement so that cuttings that are collected can be guided into a desired transport path.

10 Claims, 20 Drawing Sheets

(51) Int. Cl.
*E21B 17/10* (2006.01)
*E21B 17/22* (2006.01)

(56) References Cited

U.S. PATENT DOCUMENTS

| | | | | |
|---|---|---|---|---|
| 1,362,775 | A * | 12/1920 | Bunker | E21B 37/00 166/107 |
| 2,557,925 | A | 6/1951 | Stokes | |
| 3,151,689 | A | 10/1964 | Bennett et al. | |
| 3,321,034 | A * | 5/1967 | Webb | E21B 10/445 175/58 |
| 10,240,417 | B2 * | 3/2019 | Stangeland | E21B 27/04 |
| 11,788,383 | B2 * | 10/2023 | Schindler | E21B 10/00 166/311 |
| 2008/0023033 | A1 * | 1/2008 | Potter | E21B 27/04 134/10 |
| 2017/0030147 | A1 * | 2/2017 | Nkwocha | E21B 4/003 |
| 2020/0030004 | A1 | 1/2020 | Jackson et al. | |
| 2020/0300049 | A1 * | 9/2020 | Edvardsen | E21B 27/04 |
| 2021/0123344 | A1 * | 4/2021 | Westacott | E21B 49/08 |

FOREIGN PATENT DOCUMENTS

| | | |
|---|---|---|
| EP | 0085665 A | 8/1983 |
| JP | S6031808 | 2/1985 |
| JP | H06503615 | 4/1994 |
| JP | 2004512193 | 4/2004 |
| JP | 2007262719 | 10/2007 |
| JP | 2010121391 | 6/2010 |
| JP | 2019534404 | 11/2019 |
| WO | 9209782 | 5/1992 |

OTHER PUBLICATIONS

ISR WOISA in corresponding PCT application.
Office Action in JP2024-577390 of Apr. 15, 2026, with translation, submitted iter alia aas a statement of relevance for any non-English references cited therein.

* cited by examiner

COLLECTION UNIT FOR CUTTINGS

FIELD OF THE INVENTION

The present invention relates to the removal of drill cuttings during drilling operations, and more particularly to a system and a cuttings collector for collecting cuttings in order to analyse the cuttings.

BACKGROUND ART

The present invention concerns systems for collecting drill cuttings in order to analyse the cuttings. The cuttings mainly consist of fine particles, which may provide valuable information about the rock when analysed. The cuttings are transported out of the borehole with the drilling liquid/mud.

In the analysis of drill cuttings, the mining industry has a need for an accurate determination of the location from which the cuttings were extracted. This would provide a better basis for decision-making with regard to the dimensioning of the quantity of explosives to use and to production planning, among other things. Today, no precise method for determining the location of extraction of a particular cuttings sample exist. Cuttings are collected after drilling.

The Norwegian patent application No. 20171943, which corresponds to U.S. US 2020/0300049 A1, discloses a downhole tool for cleaning a well, said downhole tool comprising a rotatable means for dislodging and removing material from the well. The downhole tool further comprises a reservoir for dislodged material and drive means for rotating said means for dislodging and removing material.

The U.S. Pat. No. 2,557,925 discloses a general sampler for extracting samples from boreholes, said sampler comprising a drill bit and a conveyor screw for transporting cuttings from the drill bit to an internal bore 34. Samples will fill up the space between the conveyor screw and side walls surrounding the conveyor screw.

It is an object of the present invention to provide a unit for collecting drill cuttings in order to solve problems of accurate data capture from boreholes.

SUMMARY OF THE INVENTION

The problems indicated above are solved according to the present invention by providing a cuttings collector which may form a replaceable part of a drill string used in drilling operations.

Specifically, the present invention provides a cuttings collector for obtaining drill cuttings from subterranean wellbores, comprising at least:

a. a cuttings collector stem provided with a first blade and a second blade, which blades together form a double helix blade acting as a conveyor screw having a first transport path and a second transport path, b. an external wall extending between the first blade and second blade over the entire length of both blades so that an external wall of the first transport path is formed, c. said transport path having the external wall extending between the first blade and second blade being provided with a lower wall that closes the first transport path at the lower end thereof, d. said cuttings collector stem, at the upper end thereof, being provided with a top sleeve having an opening and closing arrangement, said top sleeve, in a first position, being open to the first transport path and, said top sleeve, in a second position, being closed to the first transport path, said first transport path, when the top sleeve is in a closed position, forming a cuttings collector chamber that is closed at the upper and lower ends thereof, e. the external wall of the cuttings collector chamber being provided with one or more strainers for draining liquid from cuttings collected in the cuttings collector chamber when the top sleeve is in a first position, and f. an internal drilling mud channel extending along the entire axial length of the cuttings collector.

The second position of the top sleeve may provide an opening to the second transport path so that cuttings can be expelled along the second transport path.

The top sleeve may comprise a fixed portion having an opening and a rotatable portion, said rotatable portion being rotatable about the cuttings collector stem, with rotation being provided by a gear rim engaged with a pinion, said pinion being driven by a drive means.

The top sleeve may further comprise a rotatable top sleeve having an opening, which rotatable top sleeve may be rotatable about the cuttings collector stem, and the cuttings collector chamber, at the upper section thereof, may be provided with an opening being shaped and sized so as to match the opening of the optionally rotatable top sleeve, so that when the opening in the top sleeve and the opening in the cuttings collector chamber are aligned, then the top sleeve is in the first position and cuttings can collect in the cuttings chamber.

The cuttings collector stem, at the upper end thereof, may be provided with a threaded tool joint pin of length l1/h1, said tool joint pin being configured for engagement with a drill bit.

The cuttings collector may further comprise a wear ring, which wear ring is mountable so as to surround an upper threaded tool joint pin of the cuttings collector stem. The wear ring may have a maximum diameter OD, with the OD being greater than the diameters of the top sleeve and cuttings collector stem. In a variant of the invention, the wear ring may provide a sliding surface for the top sleeve and the diameter of the wear ring corresponds to the largest diameter of the cuttings collector.

The cuttings collector may further include one of:

a. a lower tool joint box, and b. a lower threaded tool joint pin.

According to an aspect of the invention, the cuttings collector may be configured to form a replaceable part of a drill string.

The present invention also provides a method for obtaining cuttings from subterranean wellbores, at least comprising the steps of providing:

a. a cuttings collector stem provided with a first blade and a second blade, which blades together form a single double helix blade acting as a conveyor screw having a first transport path and a second transport path, b. an external wall extending between the first blade and second blade over the entire length of both blades so that an external wall of the first transport path is formed, c. a lower wall closing the first transport path at the lower end thereof, d. a top sleeve configured to be arranged at the upper end of the cuttings collector stem, said top sleeve being provided with an opening and closing arrangement, said top sleeve, in a first position, being open to the first transport path and said top sleeve, in a second position, being closed to the first transport path, said first transport path, when the top sleeve is in a closed position, forming a cuttings collector chamber being closed at the upper and lower ends thereof, e. one or more strainers arranged on the external wall of the cuttings collector chamber for draining liquid from cuttings collected in the cuttings collector chamber when the top sleeve is in a first position, and f. an internal drilling mud channel extending over the entire axial length of the cuttings collector.

Further advantages and details of the invention will be apparent from the appended patent claims.

BRIEF DESCRIPTION OF THE DRAWINGS

The present invention will be more easily understood by referring to the accompanying drawings, in which.

DETAILED DESCRIPTION OF THE INVENTION

Figure 1:
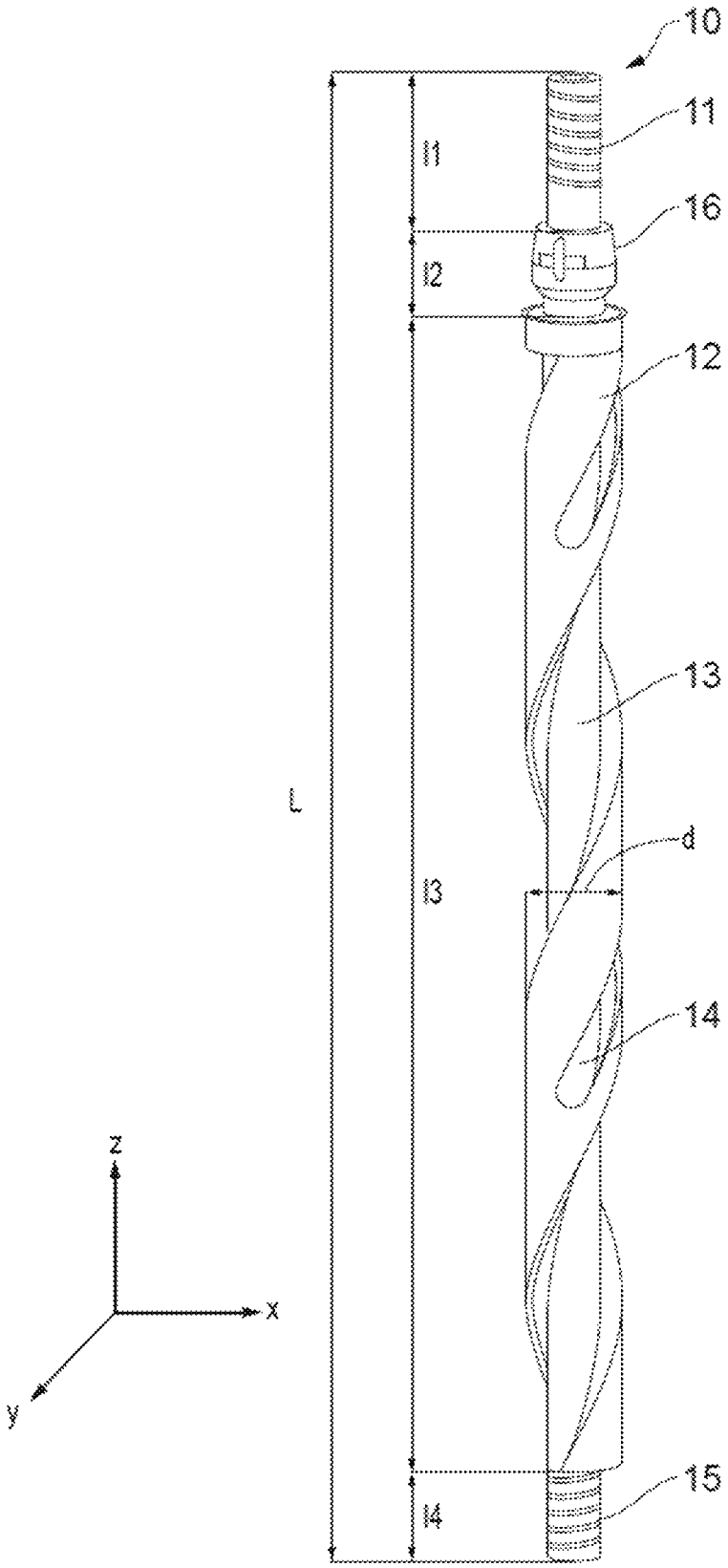
FIG. 1 shows a cuttings collector for collecting drill cuttings.

In the following, the present invention will be described in more detail with reference to the accompanying drawings.

The purpose of the cuttings collector is to obtain cuttings/samples from drilling in such a manner that parameters of the drilling can be related to specific samples. Of particular interest is to determine the extraction location of a cuttings sample. At present, cuttings are collected without any means of assigning the cuttings to a particular location.

The idea of the present invention is to provide a cuttings collector-hereinafter a cuttings collector 10, 100 in the form of a joint configured for being inserted into a drill string-which cuttings collector is mounted directly behind or almost directly behind the drill bit. The cuttings collector is provided with connections, generally in the form of threads, at each end so that a front/upper end can be connected to a drill bit or a connector while a rear/lower end can be connected to a subsequent drill pipe. The cuttings collector comprises a cuttings collector stem, said cuttings collector stem being provided with an internal axial drilling liquid/mud supply channel. The drilling liquid helps transporting cuttings in the opposite direction to the drilling direction towards the drilling opening on the outside of the drill string. The cuttings collector stem is provided with a double helix on the surface which acts as a conveyor screw having two transport paths. Surrounding the blades of the feed screw an external wall is provided so that a cuttings collector chamber is formed. The cuttings collector is also provided with an opening and closing arrangement able to allow cuttings into the cuttings collector chamber or out along a transport path of the cuttings collector stem to be expelled from the borehole.

The double helix solution providing two transport paths is not only suited to carry cuttings outwardly and away from the drill bit, but also provides a balanced solution when the cuttings collector is rotating as cuttings will coil along a cuttings collector stem and the centre of mass will coincide with the axis of rotation of the cuttings collector. Transport paths being axial relative to the cuttings collector stem will cause the cuttings collector to become unbalanced during rotation as the centre of mass will not coincide with the axis of rotation of the cuttings collector.

The drilling mud supplied via the internal channel of the cuttings collector has a pressure sufficient to carry cuttings against the drilling direction and into the cuttings collector chamber or out along the cuttings collector and further along the drill string and out of the borehole.

The solution including the cuttings collector relies on that an operator obtains location data of the drill bit at all times. When the distance between the drill bit and openings of the cuttings collector chamber is known, then a good determination of the location of origin of cuttings that is collected can be obtained.

In industrial drilling, LWD and MWD systems are commonly used. LWD and MWD systems deliver production data in real time or essentially real time to the operator. The data includes the location of the drill bit.

An Embodiment of the Invention

The cuttings collector will now be described in detail with reference to the drawings.

FIG. 1 shows an exemplary cuttings collector 10, as seen divided into four sections l1, l2, l3, and l4. The upper section has a length l1, which upper section is shown as an upper threaded tool joint pin 11. The upper tool joint pin may be configured for a direct threaded connection with a drill bit (not shown). The upper tool joint pin 11 may also be connected to other members of a drill string such as stabilizers, reamers, and the like.

The correlation between parameters collected by LWD and MWD systems and the location of origin of the cuttings will be the best if the distance between the drill bit and cuttings collector 10 is small. Therefore, cuttings collector 10 will normally be mounted close to the drill bit.

Adjacent to the upper tool joint pin 11, the figures show a replaceable wear ring 16. The wear ring 16 has a length l2, cf. FIG. 1.

The cuttings collector 10 has an elongated centre section denoted by 13 in FIG. 1. This centre section comprises a cuttings collector stem 13. Cuttings collector stem 13 is provided with a conveyor screw having two transport paths, of which one path is provided with an external wall 12. The transport path being provided with the external wall 12 forms a cuttings collector chamber. The cuttings collector chamber is provided with openings 14, the opening 14 being fitted with one or more strainer members to screen out liquid from cuttings stored in the cuttings collector chamber. The lower section of cuttings collector 10 is shown as a threaded section l5 having a length l4. The threaded section is shown with external threads. However, section l5 may also be a box adapted to the spigot of a drill pipe.

Figure 2:
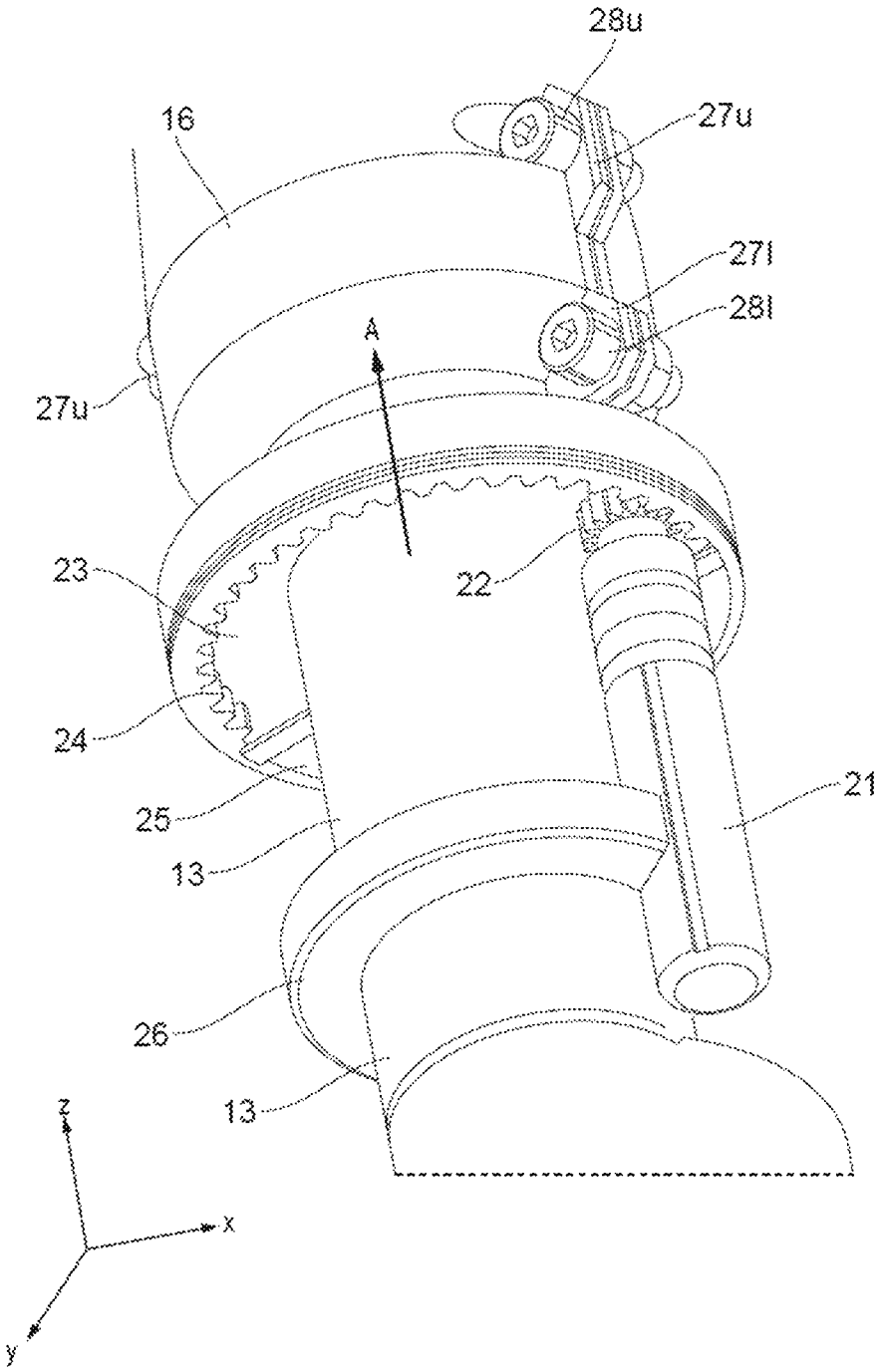
FIG. 2 shows an opening and closing assembly for opening and closing a cuttings collector chamber of the cuttings collector.

FIG. 2 shows an upper portion of the cuttings collector comprising the lower part of wear ring 16 as well as an upper part of cuttings collector 10 adjacent to wear ring 16. Wear ring 16 exhibits two upper cutters 27*u* and two lower cutters 27*l*. Upper fasteners 28*u* and lower fasteners 28*l* are also included, shown as bolts and nuts in the figure. From the figure it is seen that wear ring 16 comprises two halves, which two halves can be assembled around cuttings collector stem 13. In the figure, bolts 28*u*, 28*l* are shown inserted through protruding sections 27*u* and 27*l*, respectively. The protruding sections, in addition to be configured for the insertion of bolts therethrough, may protrude with a distance sufficient to engage the walls of a borehole so that cuttings collector 10 does not jam in the borehole. As mentioned above, the protruding cutters 27*u*, 27*l* may serve as reamers, and wear ring 16 is replaceable.

Other fasteners 28*u*, 28*l* can be envisioned, such as a hinged solution with rotation about a vertical axis and having a latch opposite to the hinge axis.

In FIG. 2, wear ring 16, a top sleeve A, a drive means 21 including a pinion 22 are pulled away from l3 and l4 for illustration purposes, cf. FIG. 1.

Top sleeve A comprises a fixed portion having an opening and a rotatable portion 23. The rotatable portion 23 is rotatable about cuttings collector stem 13, with rotation being provided for by a gear rim 24 engaged with a pinion 22. Pinion 22 is driven by a drive means 21. The rotatable portion 23 is provided with an opening 25, which opening 25 will move around cuttings collector stem 13 when the rotatable portion 23 is driven by pinion 22.

Figure 3:
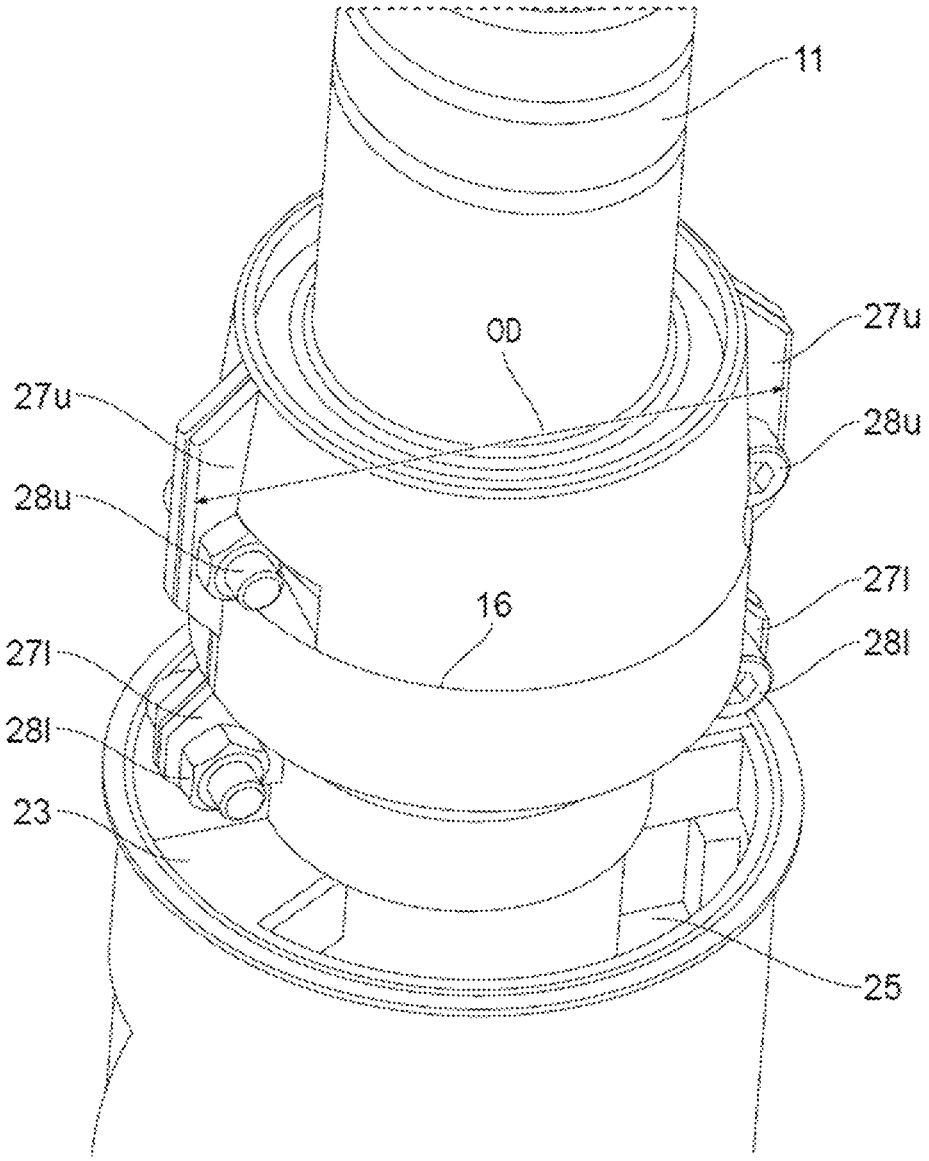
FIG. 3 shows an upper section of the cuttings collector comprising a wear ring and a rotatable cover, which in the figure is shown to be provided with an opening into the cuttings collector portion of the cuttings collector.

FIG. 3 shows the upper section of cuttings collector 10 viewed obliquely from threaded tool joint pin 11. The figure shows wear ring 16 as well as top sleeve A. The one portion of top sleeve A may be a fixed integrated part of cuttings collector section l3.

The wear ring 16 shows that a distance between the extreme points of two upper cutters 27*u* and a distance between the extreme points of two lower cutters 27*l* form the OD. To prevent cuttings collector 10 from getting stuck during a drilling operation, the OD must be greater than or equal to the diameter d of cuttings collector 10 in the area shown as 13 in FIG. 1.

FIG. 3 shows two upper cutters 27*u* and two lower cutters 27*l*. However, the use of four cutters is not necessary. The configuration of the cutters is a matter of function and design, and the use of only two cutters arranged diametrically opposite to each other can be envisioned. The cutters may serve as a reamer so that the diameter of the borehole is increased slightly compared to the diameter of the drill bit.

FIG. 3 further shows the opening and closing mechanism provided by top sleeve A in combination with drive means 21 and pinion 22. Drive means 21 and pinion 22 are not shown in FIG. 3. The fixed portion of top sleeve A has an opening 25 into a cuttings collector chamber and an opening into a portion of cuttings collector 10 intended for expelling cuttings along one of the transport paths. Alternatively, the opening in the fixed portion of top sleeve A can extend above the cuttings collector chamber and the transport path for expelling cuttings. By rotating the upper cover 23, which is provided with an opening, it will be possible to control whether the opening in the upper rotatable cover is to align with the opening of the cuttings collector chamber or the opening of the transport path for expelling cuttings.

Figure 4:
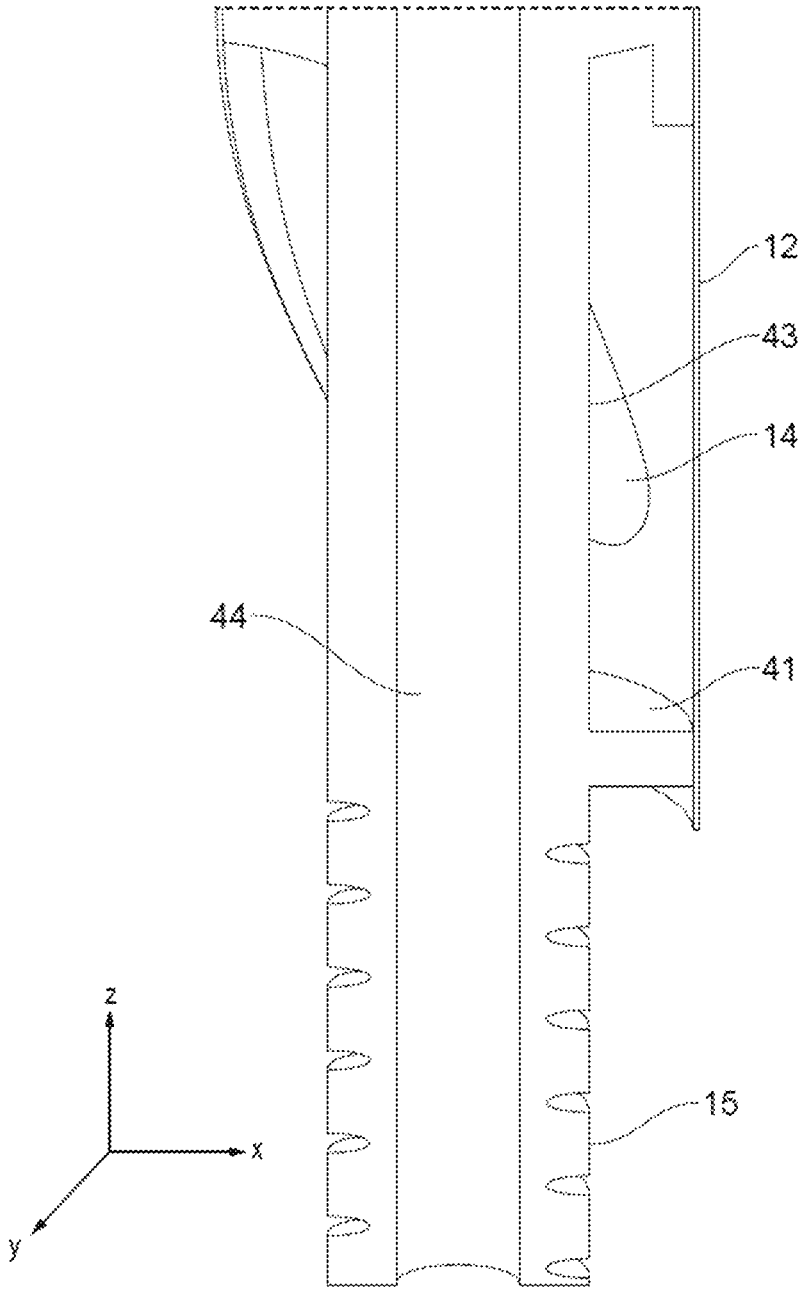
FIG. 4 shows a cross-section of a lower section of the cuttings collector with a lower portion of a cuttings collector chamber.

FIG. 4 shows a cross-section of a lower section of cuttings collector 10. In the figure, the lower section includes a lower pin 15, which lower pin 15 is adapted for engaging a drill pipe or a box. The drilling mud supply channel 44 is shown as an internal part of the cuttings collector stem. The cuttings collector chamber is bounded inwardly 43 towards cuttings collector stem 13 and externally by the wall 12 shown. The blades bounding the transport path of the cuttings collector chamber are terminated at a horizontal barrier 41, so that a cuttings collector chamber which can only be opened at its upper end, i.e. in top sleeve A, is obtained. In order for liquid to be separated from cuttings collecting in the cuttings collector chamber, walls 12 are provided with strainers that drains out fluid and leave cuttings to be analysed in the cuttings collector chamber.

Figure 5:
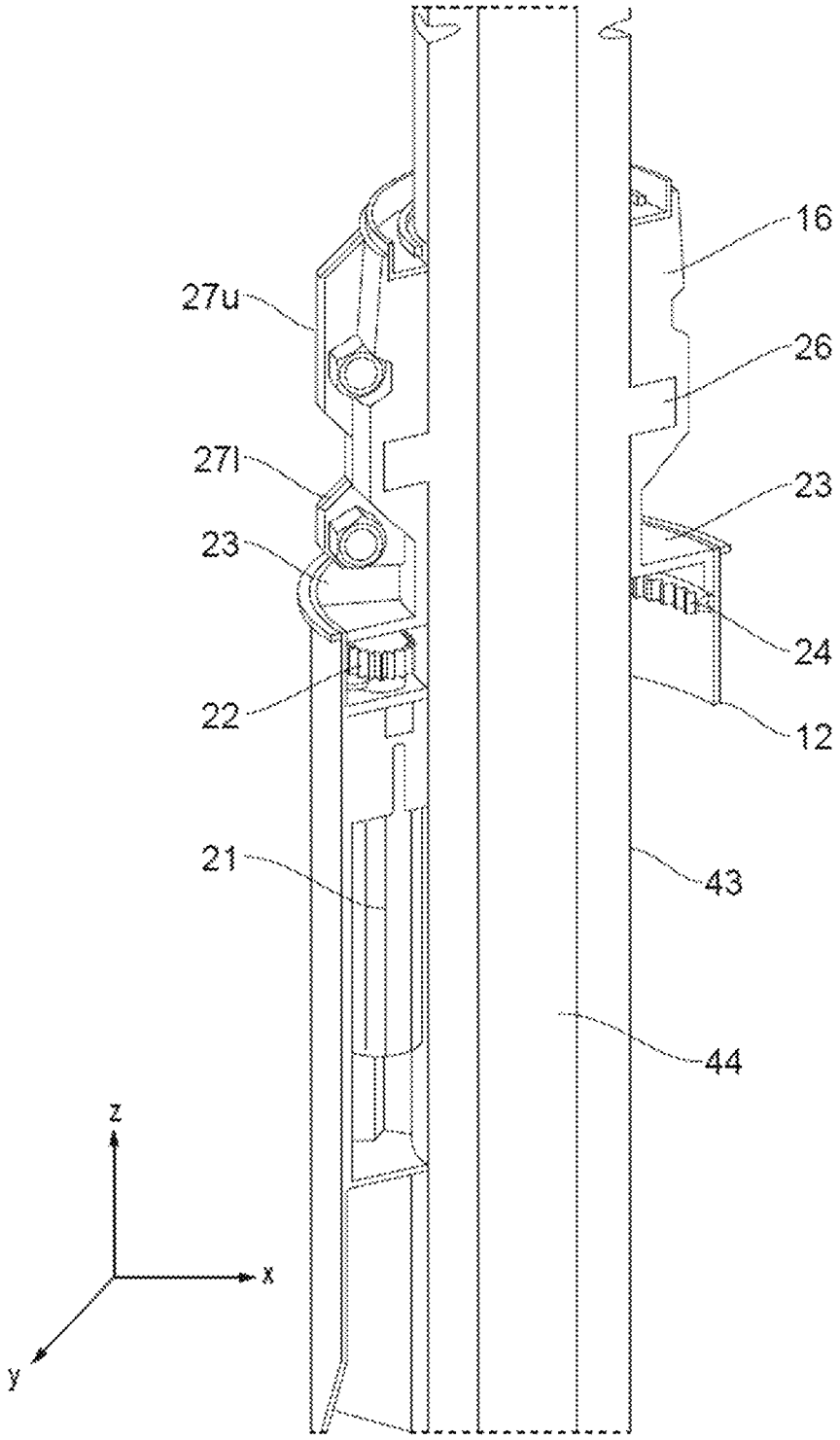
FIG. 5 shows a cross-section of the upper section of the cuttings collector comprising an opening and closing assembly for opening and closing a cuttings collector chamber of the cuttings collector.

FIG. 5 shows a cross-section of an upper portion of cuttings collector 10. Drilling mud channel 44 extends axially through the portion of the cuttings collector 10 shown. The figure shows top sleeve A having the rotatable portion 23 to be provided with a gear rim 24. Pinion 22 and drive means 21 are also shown. Also shown is a collar 26 protruding from the cuttings collector stem so that the wear ring 16 will not move in an axial direction.

Figure 6:
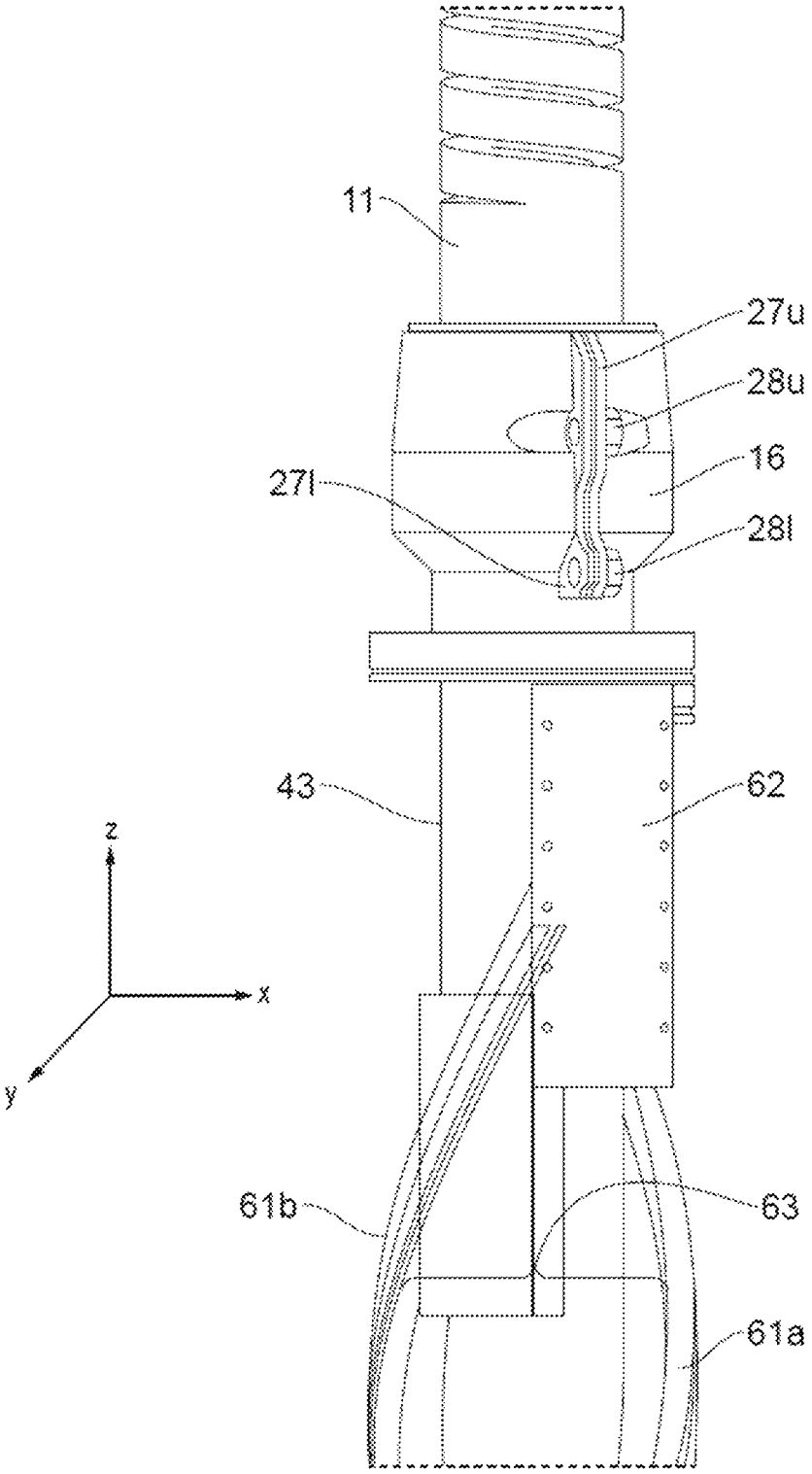
FIG. 6 shows an upper section of the cuttings collector, from which an externally surrounding wall of the cuttings collector chamber has been left out.

FIG. 6 shows an upper portion of cuttings collector 10, from which the external wall 12 has been removed so that the transport paths to the cuttings collector chamber and for expelling cuttings are shown. The figure shows two helical blades 61*a* and 61*b* having a distance 63 between them.

The distance between blades 61*a* and 61*b* defines a transport path. The cuttings collector chamber is bounded by inner lateral edges of a first blade 61*a* which winds like a helical blade/helix around cuttings collector stem 13 and inner lateral edges of a second blade 61*b* which winds like a helical blade around cuttings collector stem 13. The cuttings collector stem is not tapered and the distance between the first blade 61*a* and second blade 61*b* is the same from top to bottom of cuttings collector 10. The top of cuttings collector 10 is comprised by upper tool joint pin 11. The cuttings collector chamber 63 is further bounded by an external wall 12 (not shown) of cuttings collector stem 13 and an external wall of cuttings collector chamber 42 (not shown). FIG. 6 also shows a single entrance chamber 62 for cuttings that are collected, which cuttings proceed into the cuttings collector chamber.

Figure 7:
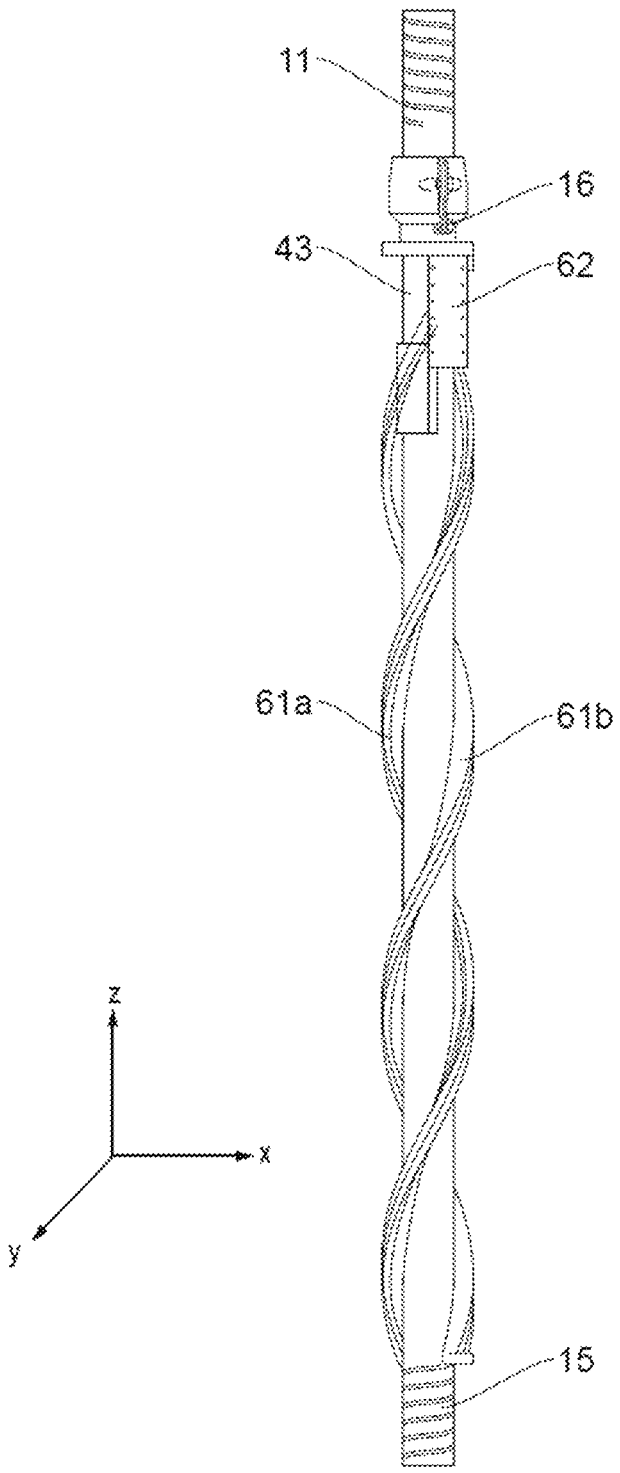
FIG. 7 shows the cuttings collector, from which an externally surrounding wall of the cuttings collector chamber has been left out.

FIG. 7 shows that cuttings collector chamber 63 extends a vertical length l3, cf. FIGS. 1 and 7. This section of cuttings collector 10 is also characterized by being provided with an open external helix on the cuttings collector stem. This includes portions that are not covered by the external wall 12 of the cuttings collector inside the vertical interval 13. This portion provides a continuous path of the cuttings collector which will act as a conveyor screw for cuttings that are not allowed into cuttings collector chamber 63.

Figure 8:
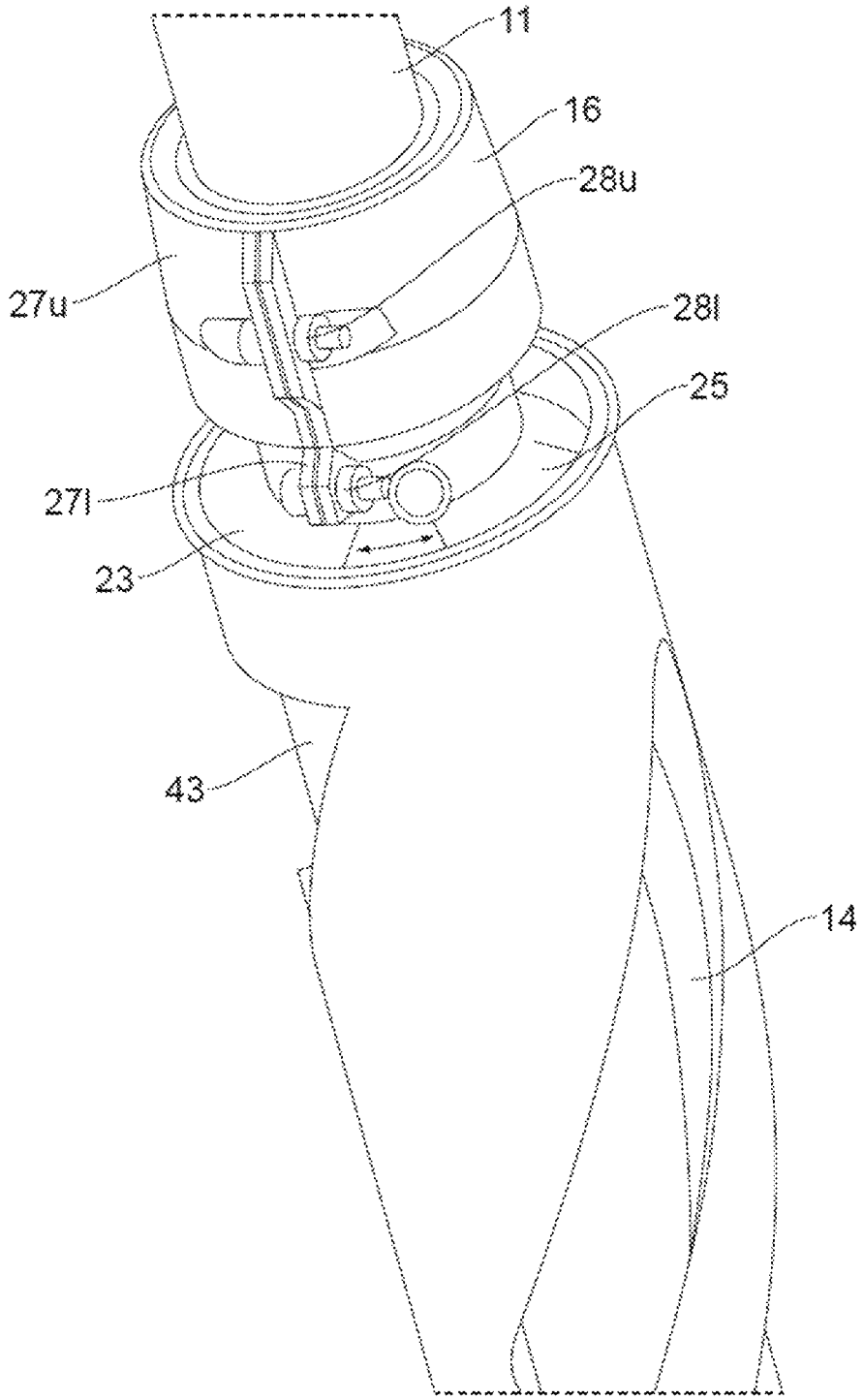
FIG. 8 shows an upper section of the cuttings collector, in which openings in the external wall of the cuttings collector chamber have been provided with strainers.

FIG. 8 shows the upper section of cuttings collector 10 including the uppermost portion of cuttings collector chamber 63 which is bounded by a "closed end" A having an opening/closing mechanism 21, 22, 23, 24, 25, cf. FIGS. 2 and 3. The "closed end" A may be a top sleeve which can be disengaged from the rest of cuttings collector chamber 63. The top sleeve A of FIG. 2 is shown with an internal gear rim 24, which gear rim 24 is mounted on a rotatable portion of top sleeve 23 that is rotatable around cuttings collector stem 13 so that an open/close function can be achieved. A pinion 22 is shown engaged with gear rim 24. The pinion is rotatable by means of a drive means 21. Drive means 21 may be an electric motor. The electric motor can be a stepper motor. When the pinion is rotating, then the rotatable portion of top sleeve 23 will rotate. The fixed portion of top sleeve A is provided with an opening 25. When the rotatable portion of the top sleeve 23 is rotated on top of opening 25, a full or partial closure of top sleeve A is achieved.

When a sample is to be collected, the open/close mechanism can be controlled by increasing the rotation speed of the drill bit. When the sample is to be collected, this is done with the normal rotation speed of the drill bit.

Figure 9:
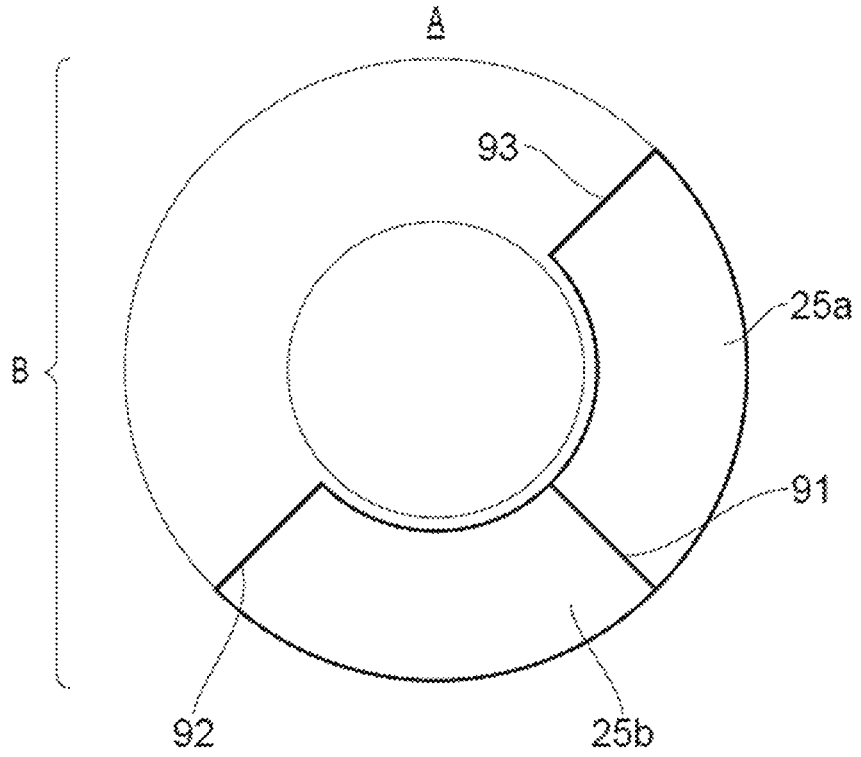
FIG. 9 shows details of an opening and closing mechanism for opening and closing access to a cuttings collector chamber.
Figure 9:
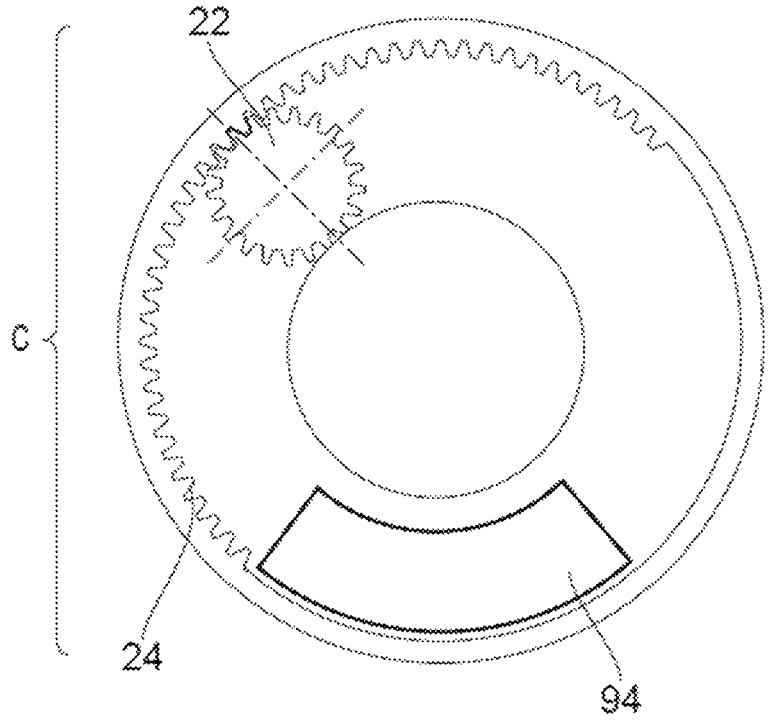

FIG. 9 shows the opening/closing mechanism of top sleeve A in more detail. The upper part B of the figure shows the fixed portion of the top sleeve comprising two openings 25*a* and 25*b*. Openings 25*a* and 25*b* could be a single opening 25. Also, opening 25 or 25*a* and 25*b* may form a substantial part or even cover a full 360° sector.

The rotatable portion 23 of the top sleeve is shown in the lower part C of FIG. 9. Opening 94 defines the opening that may be provided in order to allow cuttings into the cuttings collector chamber or out to the transport path to expel cuttings from the borehole.

A Second Embodiment

Figure 10:
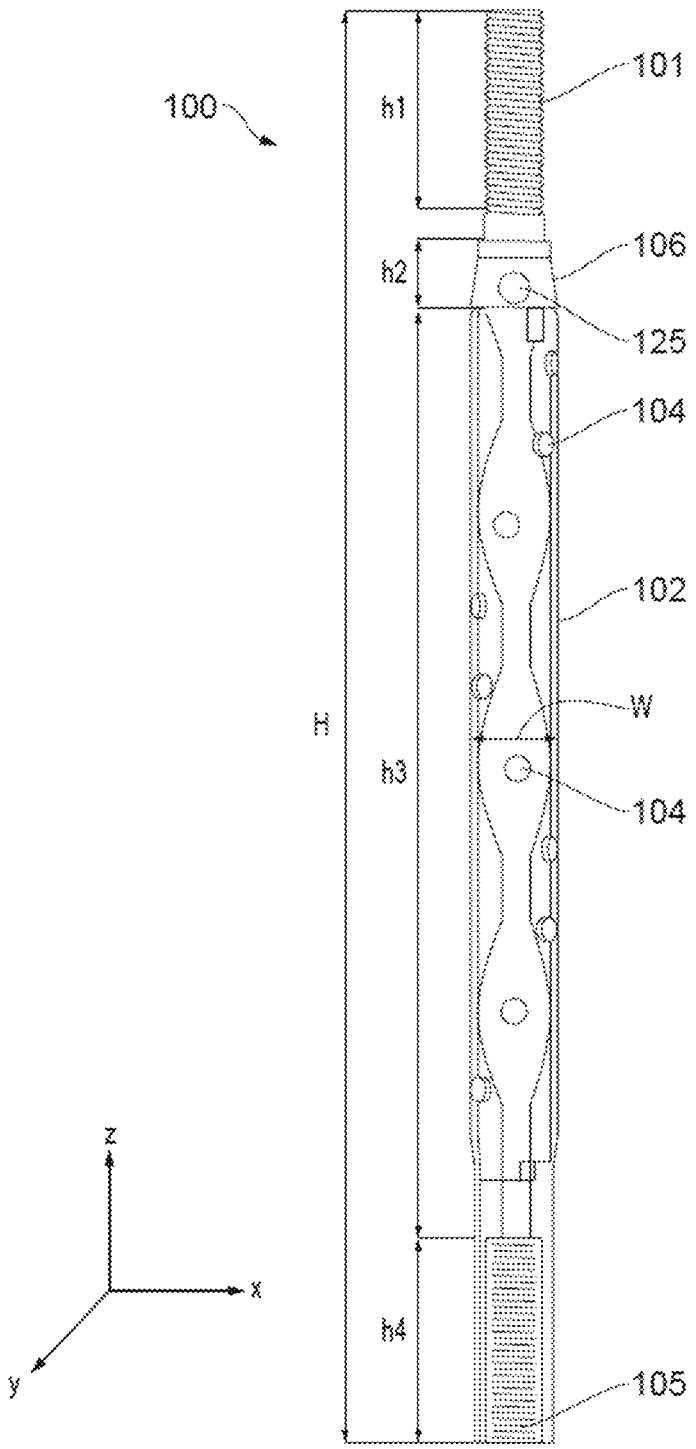
FIG. 10 shows a cuttings collector for collecting drill cuttings.

FIG. 10 shows a second embodiment of a cuttings collector. The principle of using conveyor screws for carrying cuttings into a cuttings collector chamber or out of the wellbore is the same as in the first embodiment of cuttings collector 10 discussed above. The second embodiment shows a cuttings collector 100 in which the top sleeve including a horizontal surface having openings therein is replaced by a top sleeve 106 shaped essentially as a conical frustum. Top sleeve 106 is provided with an opening which can align with openings into a cuttings collector chamber or to a transport path for expelling cuttings. The combined aligned openings are shown with reference numeral 125 in FIGS. 10-15.

The cuttings collector 100 shown in FIG. 10 is divided into four sections, including an upper section h1 forming the tool joint pin 101 of the cuttings collector corresponding to a tool joint pin of a drill pipe. An intermediate region between h1 and h2 is not assigned any reference numeral. Cuttings collector 100 further comprises the top sleeve having an axial length l2 discussed above.

Adjacent to l2, section h3 of the cuttings collector including the cuttings collector chamber is found. At the bottom of the cuttings collector a box 105 is shown, having a length h4. Box 105 is adapted for engagement with the spigot of a drill pipe.

Cuttings collector 100 is shown to exhibit an alternate external wall 102 extending across the intermediate section h3 of cuttings collector 100.

The strains 104 of cuttings collector 100 differ from those shown of cuttings collector 10 in that their surface area is significantly smaller.

Cuttings collector 100 is shown with a diameter w.

Figure 11:
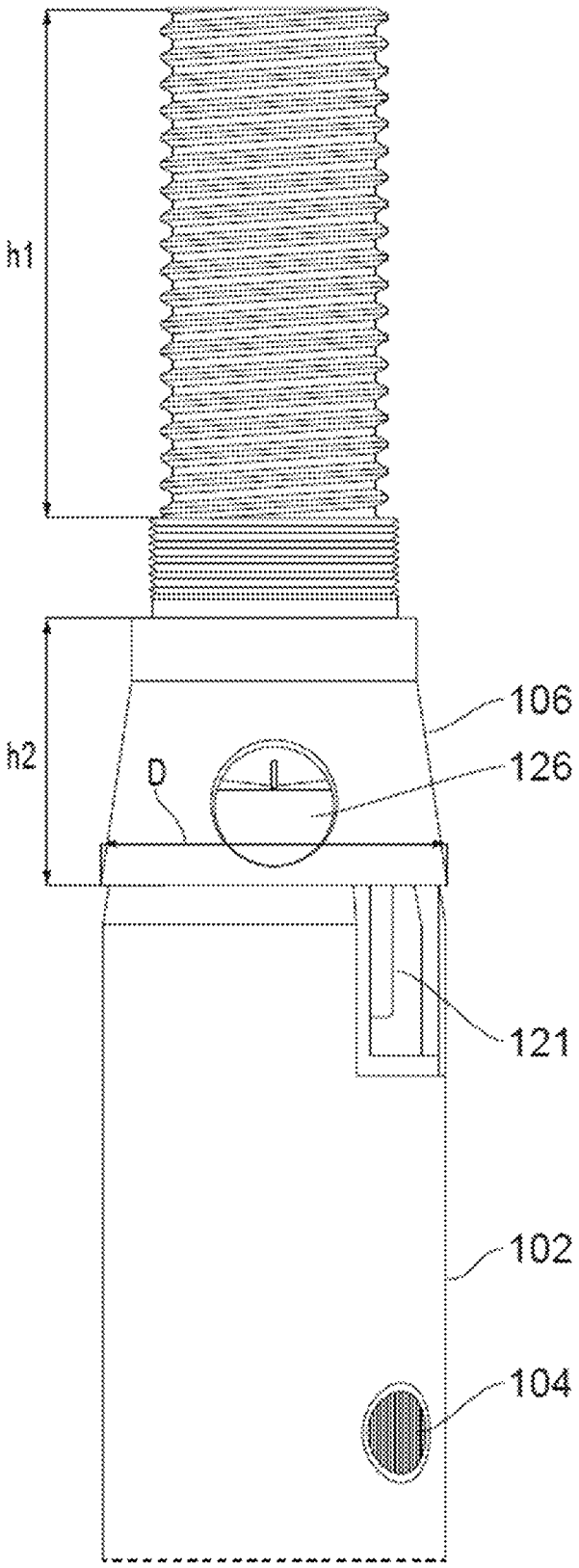
FIG. 11 shows an upper section of a cuttings collector having a rotatable sleeve provided with access openings to a cuttings collector chamber.

FIG. 11 shows the upper portion of cuttings collector 100 in more detail. A section has been cut away from the figure exposing a drive means 121, which drive means 121 is operable to rotate top sleeve 106 about a vertical axis. This is discussed in more detail with reference to other drawings. Top sleeve 106 is shown to have a maximum diameter D.

The design of top sleeve 106 will not be suitable as a "reamer." Also, a top sleeve 106 protruding beyond the diameter w could wear on the transmission between a drive means and an internal gear rim of top sleeve 106 (not shown). Therefore, cuttings collector 100 may be provided with a wear ring 1516 as shown in FIG. 15C and discussed in the description of FIG. 15C. Where not otherwise indicated, the second embodiment of cuttings collector 100 is provided with a wear ring 1516 as shown in FIG. 15C.

Figure 12A:
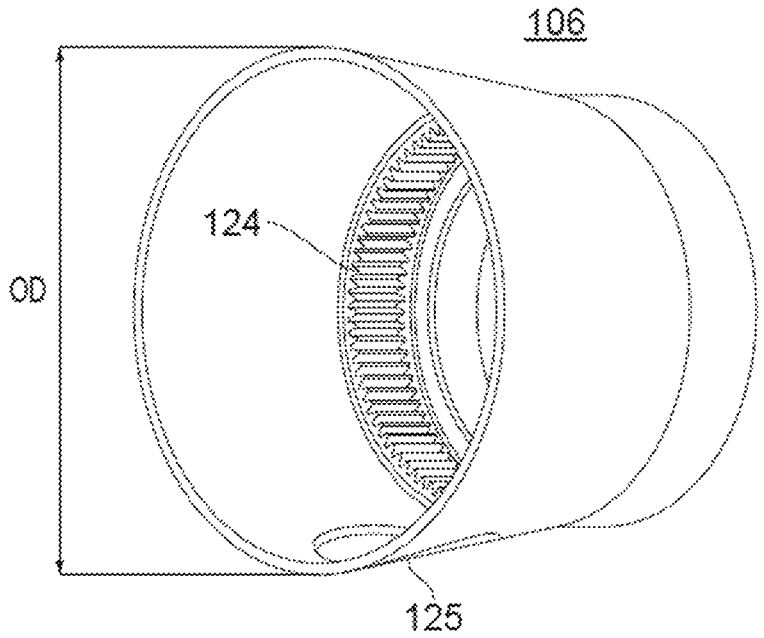
FIG. 12*a* shows a rotatable top sleeve of the cuttings collector chamber, having openings able to close and open access to the cuttings collector chamber, which top sleeve may be shaped as a conical frustum.

FIG. 12*a* shows the top sleeve isolated from cuttings collector 100, which top sleeve is shown with a gear rim 124. In this figure, the gear rim is shown in an upper portion of top sleeve 106, which in the present case is not tapered. The remaining portion of top sleeve 106 forms a conical frustum. Top sleeve 106 is shown with an opening 125. Opening 125 may align with openings in cuttings collector 100 which allow access to a cuttings collector chamber or to a transport path to expel cuttings.

In order to prevent the cuttings collector 100 from getting stuck in a wellbore and/or the top sleeve 106 from engaging the walls of the wellbore, a wear ring 16 can be mounted to the cuttings collector as shown in FIGS. 2, 3 and 5-8, or alternatively, and as shown in FIG. 15C, a wear ring 1516 can be mounted.

Figure 12B:
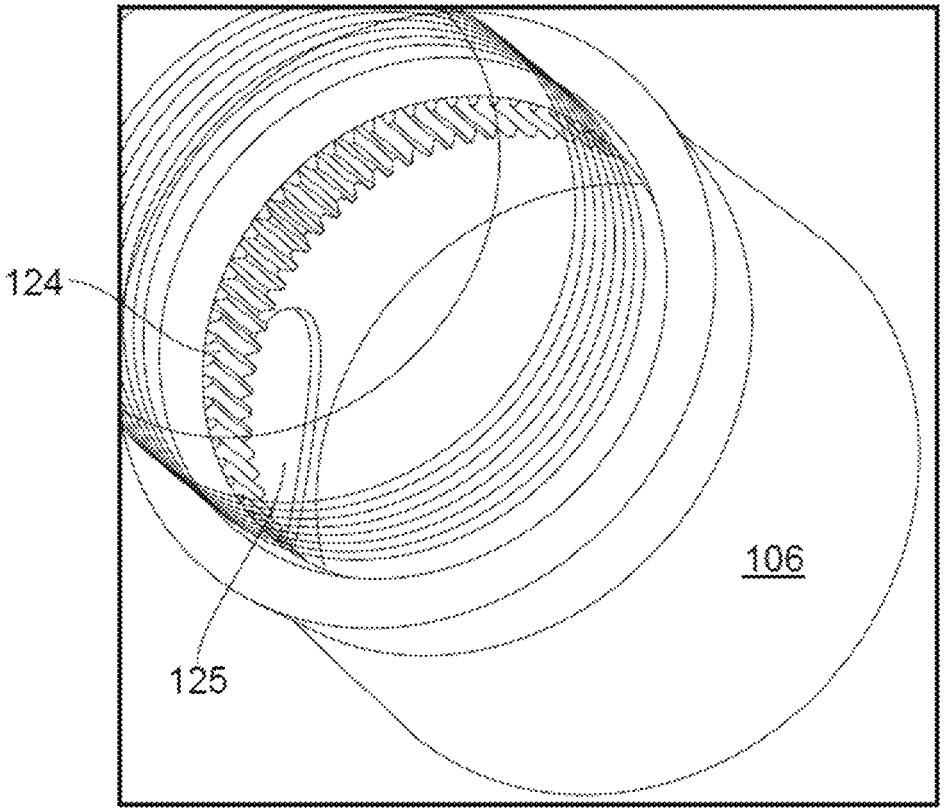
FIG. 12*b* shows the rotatable top sleeve viewed from a different angle than FIG. 12*a*.

FIG. 12*b* shows top sleeve 106 viewed from a different angle.

Figure 13:
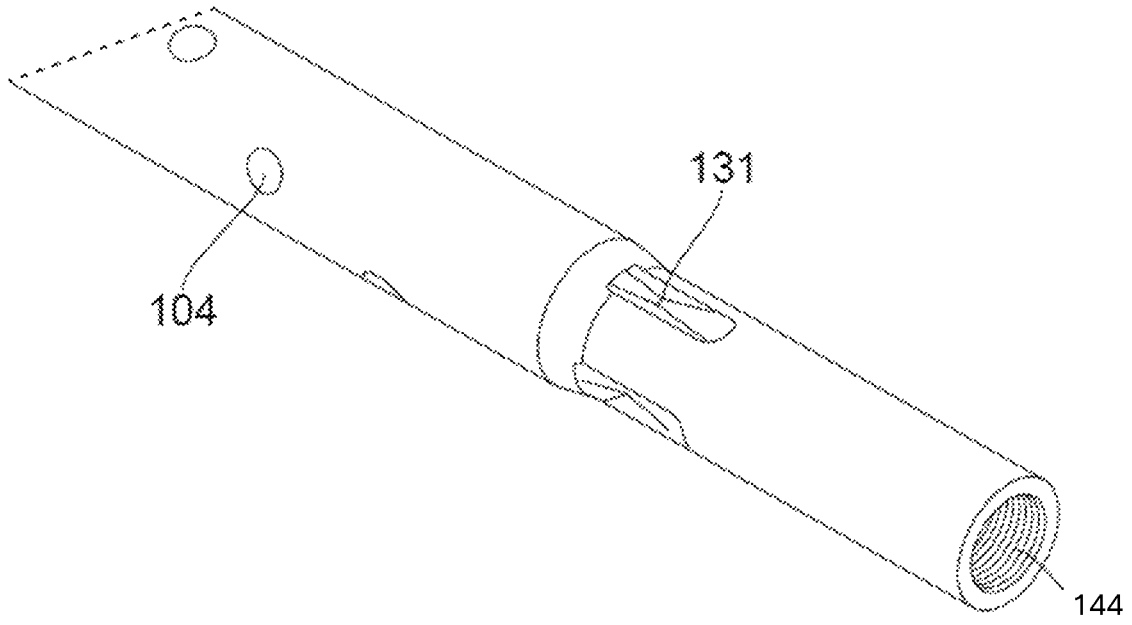
FIG. 13 shows the lower box portion of a cuttings collector.

FIG. 13 shows a lower portion of cuttings collector 100. The figure shows two strainers for screening out liquid from the cuttings collector chamber so that cuttings in the cuttings collector chamber do not contain too much liquid. The lower portion of cuttings collector 100 includes openings 131 for transporting mud/cuttings from the transport path for discharging cuttings, that is, the path that does not form the cuttings collector chamber.

The lower section of cuttings collector 100 comprises a box tool joint 144 with threads matching the pin tool joint of a drill pipe.

Figure 14A:
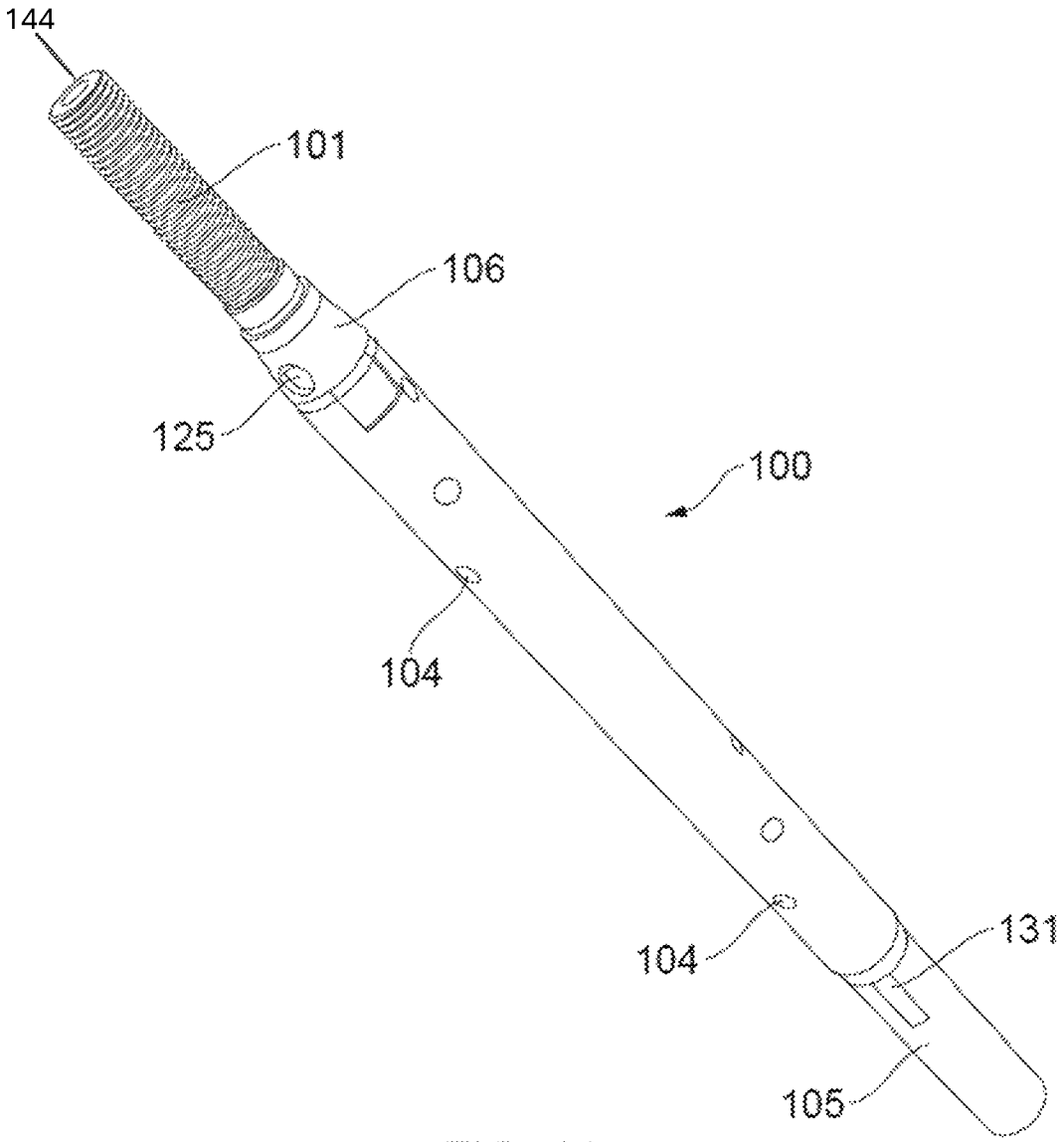
FIG. 14*a* shows a cuttings collector.

FIG. 14*a* shows a cuttings collector 100 comprising an upper tool joint pin 101 having an axial channel 144 for supplying drilling mud to a drilling operation. FIG. 14*a* further shows top sleeve 106 with an opening 125—that is, the opening in top sleeve 106 is aligned with the opening into one of the transport paths of cuttings collector 100.

The lower section of the cuttings collector is denoted with reference numeral 105.

Figure 14B:
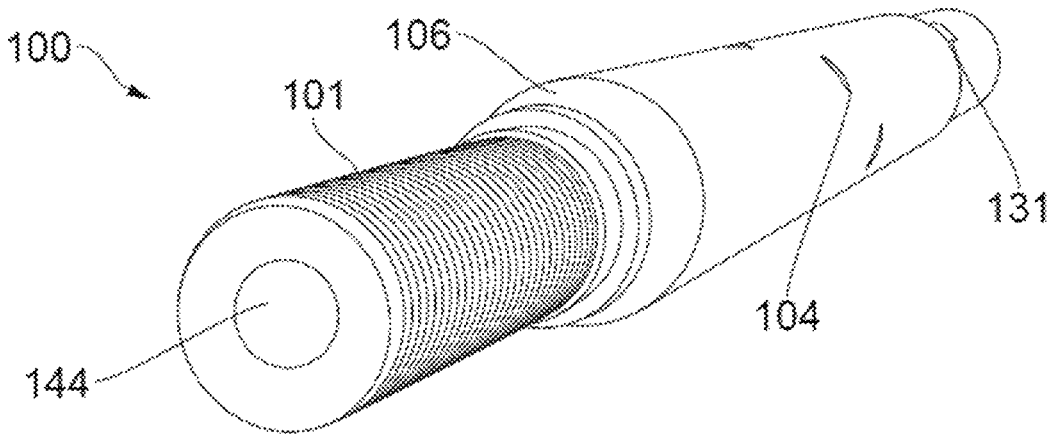
FIG. 14*b* shows a cuttings collector.

FIG. 14*b* is a perspective view of cuttings collector 100 as seen obliquely from the pin 101. The axial drilling mud supply channel 144 is clearly seen.

Figure 14C:
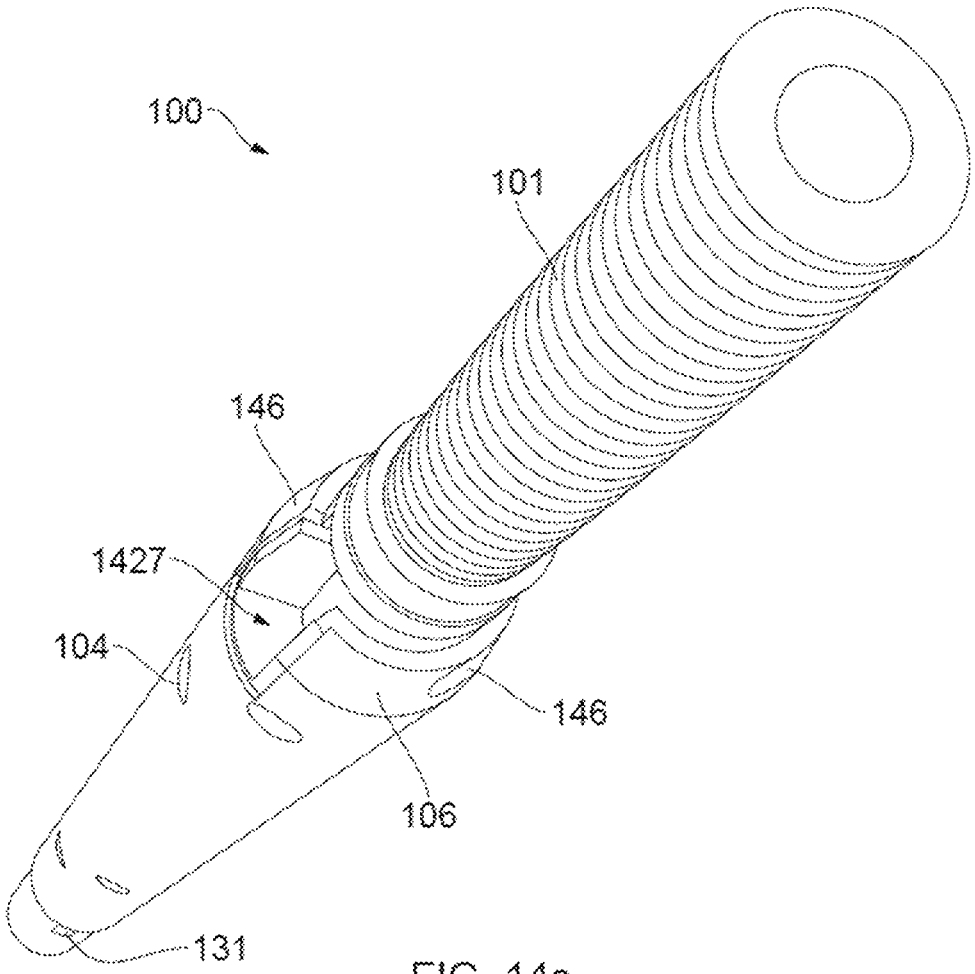
FIG. 14*c* shows a cuttings collector.

FIG. 14*c* is a perspective view of cuttings collector 100, from which top sleeve 106 as well as a cover have been left out. The cover covers a compartment 1427 for drive means 121. The drive means has been left out from the figure.

Note that the figure shows two openings 146, of which one leads to a cuttings collector chamber and the other leads to a transport path to expel cuttings from the wellbore.

Figure 14D:
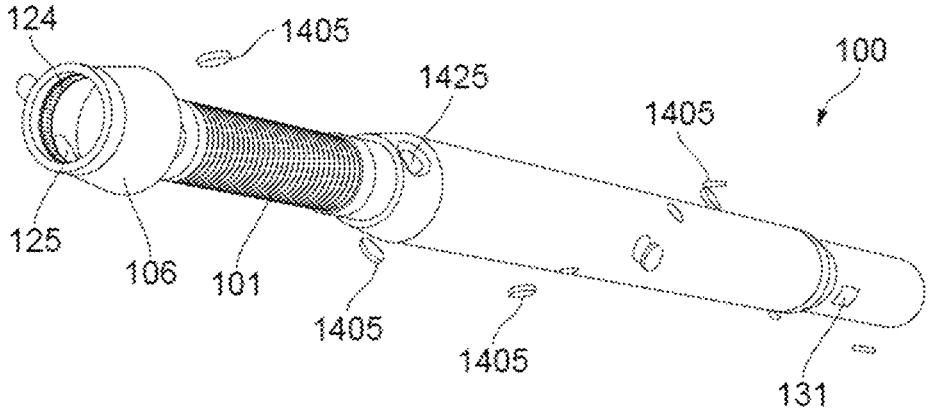
FIG. 14*d* shows an exploded view of a cuttings collector.

FIG. 14*d* shows cuttings collector 100 in an exploded view. The strains 104 of the cuttings collector may be provided with gratings 1425 to protect the strains 104 as shown in the figure.

Figure 14E:
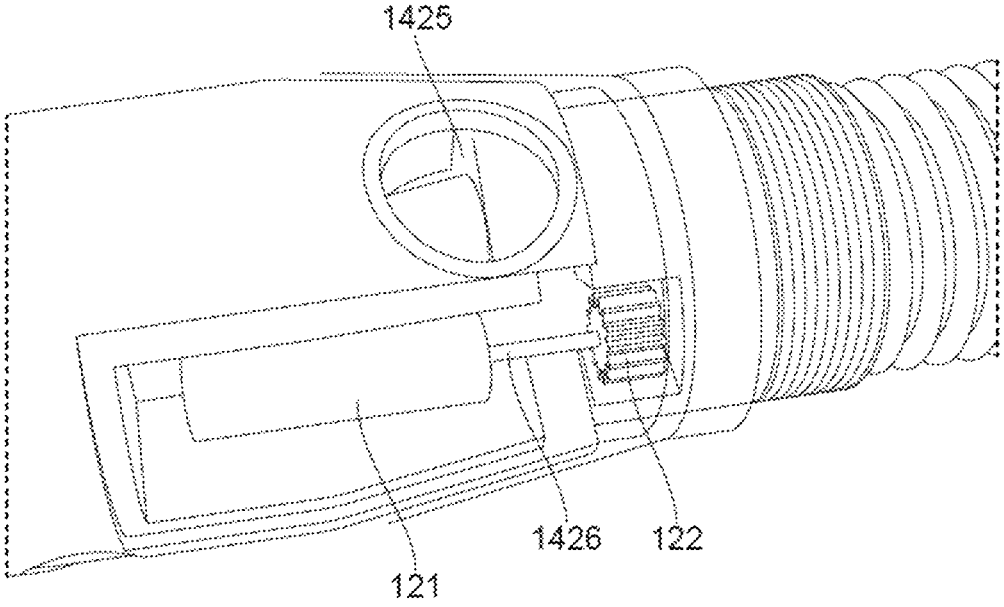
FIG. 14*e* shows details of a cuttings collector.

FIG. 14*e* shows a sectional view of a cuttings collector 100, from which top sleeve 106 has been left out. The compartment 1427 for drive means 121 is clearly shown and it is seen that the drive means is connected to a pinion 122 via a shaft 1426. The pinion is arranged so as to be able to engage with gear rim 124. An opening 146 in the sample chamber is clearly shown.

Figure 15A:
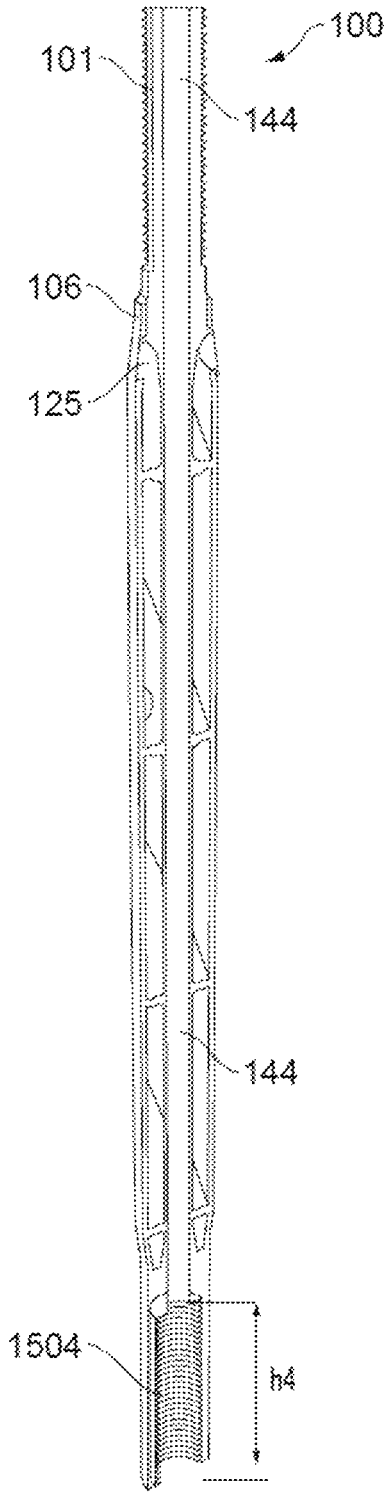
FIG. 15*a* shows the cross-section of a cuttings collector.

FIG. 15*a* shows a cross-section of cuttings collector 100. It can be seen that the drilling mud supply channel 144 extends along the length of the cuttings collector. In the figure, the opening in top sleeve 106 is aligned with one of the openings in the main body of the cuttings collector. The figures show helical blades extending from the top sleeve to the lower section of the cuttings collector.

Figure 15B:
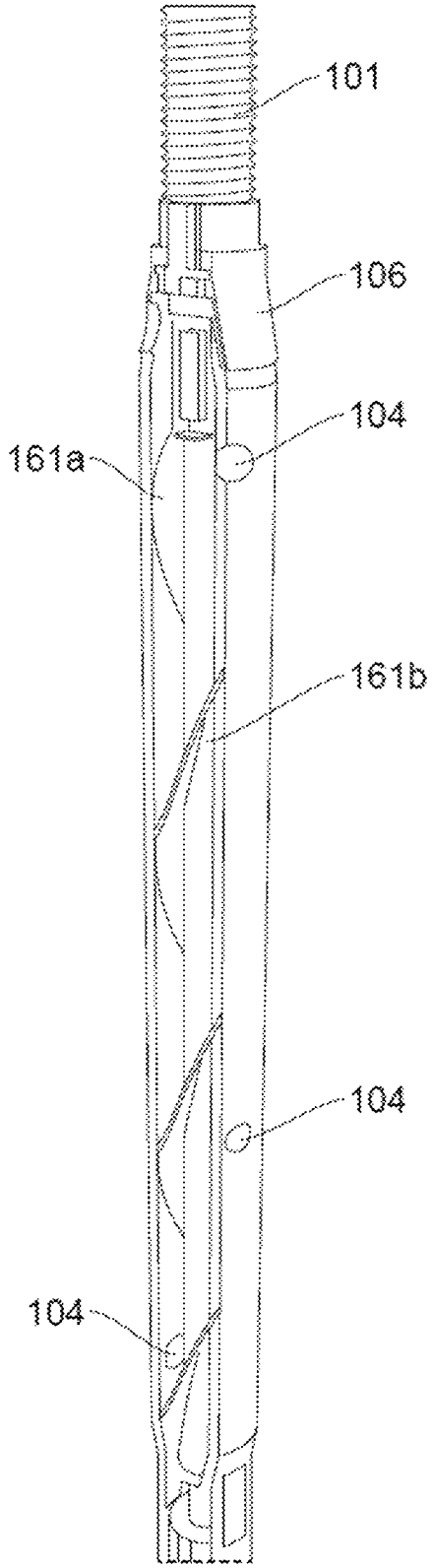
FIG. 15*b* shows the cross-section of a cuttings collector.
Figure 15C:
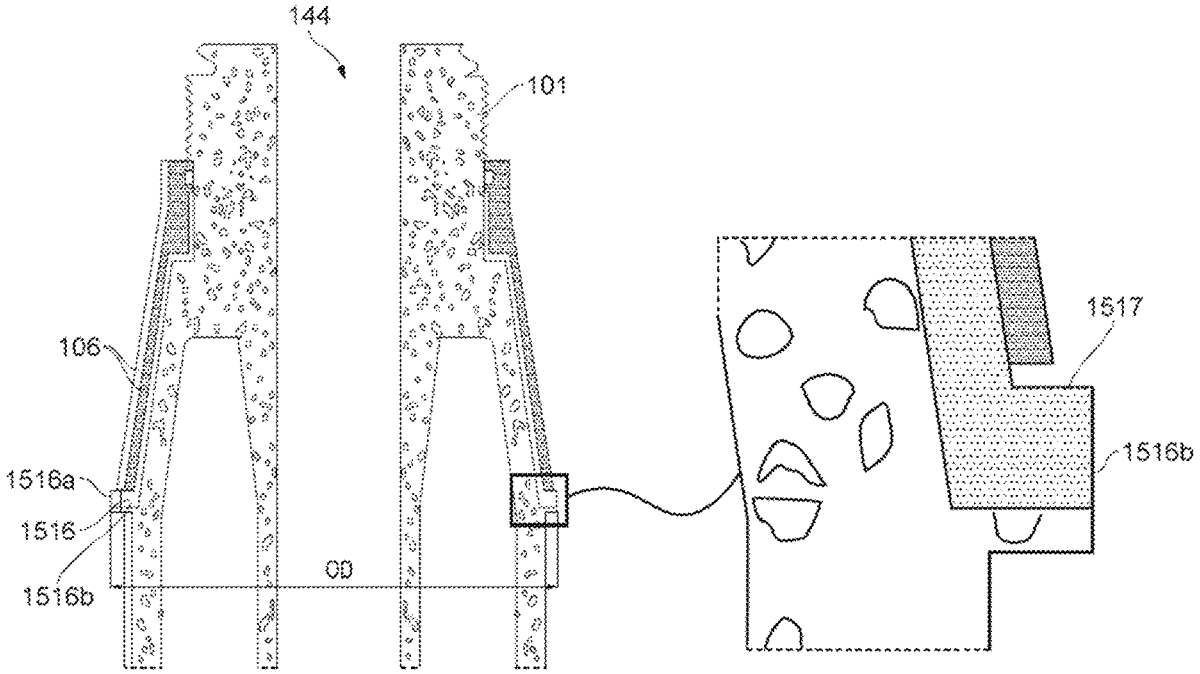
FIG. 15C shows a section of a cuttings collector that includes a wear ring.

FIG. 15*b* shows a cross-section of cuttings collector 100. The figure clearly shows the internal transport paths provided by the two helical blades extending from the top sleeve down towards the lower section of the cuttings collector.

FIG. 15C shows a cross-section of an upper section of cuttings collector 100. It is seen from the figure that cuttings collector 100 has a maximum external diameter D, said maximum external diameter D being provided by a wear ring 1516.

The wear ring is susceptible to many embodiments. In the figure it is shown in the form of an inner wear ring bushing 1516B configured to surround the upper portion of an inner core of cuttings collector 100. Wear ring bushing 1516B is shown with an external wear layer 1516A. Together, wear ring bushing 1516B and wear layer 1516A form the wear ring 1516 of cuttings collector 100.

In an embodiment, wear ring 1516 may be formed in one piece.

Wear ring 1516 may be replaceable, or alternatively wear layer 1516B may be replaceable.

| | |
|---|---|
| 10 | Cuttings collector for collecting/obtaining cuttings/formation samples, i.e. a cuttings collector. |
| 11 | Upper threaded pin. |
| 12 | External wall of cuttings collector chamber 63. |
| 13 | Cuttings collector stem having two helical cutters extending axially along the cuttings collector stem. |
| 14 | Strainer mounted in windows of the external wall of the cuttings collector chamber. |
| 15 | Lower threaded pin |
| 16 | Wear ring. External diameter OD ≥ d. The wear ring prevents the cuttings collector 10 from getting stuck in a drill hole. |
| 21 | Drive means. The drive means can be an electric motor (e.g. stepper motor), hydraulic motor or drilling mud engine. |
| 22 | Pinion for engagement with gear rim having internal threads. The pinion is driven by drive means 21. |
| 23 | Movable part of the top sleeve of cuttings collector chamber 63. The movable part of the top sleeve is rotatable about a vertical axis (L) by engagement between the gear rim and gear wheel. |

-continued

| | |
|---|---|
| 24 | Gear rim with internal ring. |
| 25 | Opening. The size of opening 25 is adjustable by the movable part of top sleeve 23. 25 includes 25a and 25b. |
| 25a | Opening to cuttings collector chamber in upper top sleeve B |
| 25b | Opening for returning mud along cuttings collector stem 13. |
| 26 | Collar of cuttings collector stem. To make sure wear ring 16 does not move in an axial direction. |
| 27u | Upper cutter and attachment lug of wear ring. The wear ring may be provided with two upper cutters/attachment lugs diametrically opposite to each other. |
| 27l | Lower cutter and attachment lug of wear ring. The wear ring may be provided with two lower cutters/attachment lugs diametrically opposite to each other. |
| 28u | Fastener for upper attachment lug/cutter of wear ring. In the figures, the fastener is shown as a screw and nut. |
| 28l | Fastener for lower attachment lug/cutter of wear ring. In the figures, the fastener is shown as a screw and nut. |
| 41 | Lower part of cutter of cuttings collector chamber 63. |
| 43 | Internal wall of cuttings collector chamber 63 and external wall of cuttings collector stem. |
| 44 | Drilling liquid/mud supply channel. |
| 61a | First cutter of cuttings collector chamber 63. |
| 61b | Second cutter of cuttings collector chamber 63. |
| 62 | Entry chamber for cuttings that are collected. Cuttings proceed into the cuttings collector chamber. |
| 63 | Cuttings collector chamber. The cuttings collector chamber is bounded by inner lateral edges of the first cutter, inner lateral edges of the second cutter, external wall of the cuttings collector stem, and internal wall of cuttings collector chamber 43. |
| 91 | Partition wall between the opening to the cuttings collector chamber and opening for returning mud between screw cutters 61a and 61b outside the cuttings collector chamber. |
| 92 | Opening in partition wall for return of sludge. |
| 93 | Opening in partition wall to cuttings collector chamber |
| 94 | Opening in lower top sleeve, said lower top sleeve being rotatable about the vertical axis L by engagement with pinion 22. Alignment of opening 94 and openings in the upper top sleeve provides access to the opening to cuttings collector chamber or opening for mud return opening along cuttings collector stem 13. |
| 100 | A second cuttings collector for collecting/obtaining cuttings/formation samples, i.e. a cuttings collector. |
| 101 | Upper threaded tool joint pin. |
| 102 | External wall of cuttings collector chamber. |
| 104 | Strainer mounted in windows of the external wall of cuttings collector chamber. |
| 105 | Lower tool joint box |
| 106 | Movable part, a top sleeve, of the cuttings collector chamber. The top sleeve are rotatable about the vertical axis (L) by engagement between gear rim 124 and gear wheel (pinion) 122. |
| 121 | Drive means. The drive means may be an electric motor (e.g. stepper motor), hydraulic motor or drilling mud engine. |
| 122 | Pinion for engagement with gear rim 124 having internal threads. The pinion 122 is driven by drive means 121. |
| 124 | Gear rim with internal rim. |
| 125 | Top sleeve opening. |
| 126 | Aligned opening between opening 125 of top sleeve 106 and openings 146 of cuttings collector. |
| 131 | Openings for transporting drilling mud/cuttings from the transport path for discharging cuttings |
| 144 | Drilling liquid/mud supply channel |
| 146 | Opening to the cuttings collector chamber and transport path for expelling cuttings. |
| 1405 | Grating |
| 1425 | Opening in the cuttings collector to the cuttings collector chamber or opening for returning mud between helical cutters outside the cuttings collector chamber |
| 1426 | Axle from the drive means to pinion 122 |
| 1427 | Compartment for drive means 121 |
| 1516 | A second variant of the wear ring, which second wear ring variant may comprise a wear layer 1516a and a wear ring bushing 1516b |
| 1516a | Wear layer, may be integrated with wear ring bushing 1516b or form a separate part. |
| 1516b | Wear ring bushing. The wear ring bushing may be integrated with the wear layer 1516a or be a separate part. |
| 1417 | Sliding surface, contact surface between the wear ring and top sleeve 106 |
| d | External diameter of cuttings collector, l3 |

-continued

| | |
|---|---|
| D | Maximum external diameter of top sleeve 106 |
| w | External diameter of cuttings collector, h3 |
| l1 | Axial length of upper threaded tool joint pin |
| l2 | Axial length of replaceable wear ring |
| l3 | Axial length of the cuttings collector portion of cuttings collector 10. |
| l4 | Axial length of lower threaded tool joint pin |
| h1 | Axial length of upper threaded tool joint pin |
| h2 | Axial length of replaceable wear ring |
| h3 | Axial length of the cuttings collector portion of cuttings collector 100 |
| h4 | Axial length of threaded section of the tool joint box |
| L | Axial length of cuttings collector 10. |
| H | Axial length of cuttings collector 100 |
| A | Top sleeve having a gear rim ring. Elevated from the cuttings collector chamber to expose gear rim (cf. FIG. 2) 24 with gear wheel 22. |
| B | Upper portion of top sleeve A, without the gear rim ring having an opening |
| C | Lower part of top sleeve B, with a gear rim and opening for a single opening 25a or 25b |
| OD | Maximum external diameter of wear ring. OD ≥ d |
| X | The x-axis of a Cartesian system is horizontal and, together with the y-axis, represents a horizontal plane. The x-axis is perpendicular to the axial direction of the cuttings collector stem |
| Y | The y-axis of a Cartesian system is horizontal and, together with the x-axis, represents a horizontal plane. The Y axis is perpendicular to the axial direction of the cuttings collector stem. |
| Z | The z-axis of a Cartesian system is vertical and, together with the y-axis, represents a vertical plane. The z-axis is parallel to the axial direction of the cuttings collector stem. |
| LWD | Logging while drilling. |
| MWD | Measuring while drilling |

The invention claimed is:

1. A cuttings collector for obtaining drill cuttings from subterranean wellbores, comprising at least:

a) a cuttings collector stem provided with a first blade and a second blade, which together form a double helix blade acting as a conveyor screw having a first transport path and a second transport path, b) an external wall extending between the first blade and second blade over the entire length of both blades so that an external wall of the first transport path is formed, c) said transport path having the external wall extending between the first blade and second blade being provided with a lower wall that closes the first transport path at the lower end thereof, d) said cuttings collector stem, at the upper end thereof, being provided with a top sleeve having an opening and closing arrangement, said top sleeve, in a first position, being open to the first transport path, and said top sleeve, in a second position, being closed to the first transport path, said first transport path, when the top sleeve is in a closed position, forming a cuttings collector chamber that is closed at the upper and lower ends thereof, e) the external wall of the cuttings collector chamber being provided with one or more strainers for draining liquid from cuttings collected in the cuttings collector chamber when the top sleeve is in a first position, and f) an internal drilling mud channel extending along the entire axial length of the cuttings collector.

2. A cuttings collector according to claim 1, wherein the second position of the top sleeve provides an opening to the second transport path so that cuttings can be expelled along the second transport path.

3. A cuttings collector according to claim 1, wherein the top sleeve comprises a fixed portion having an opening and a rotatable portion, said rotatable portion is rotatable about the cuttings collector stem, and rotation is provided by a gear rim engaged with a pinion, said pinion being driven by a drive means.

4. A cuttings collector according to claim 1, wherein the top sleeve comprises a rotatable top sleeve having an opening, the rotatable top sleeve is rotatable about the cuttings collector stem, and the cuttings collector chamber, at the upper section thereof, is provided with an opening being shaped and sized so as to match the opening of the rotatable top sleeve, so that when the opening in the rotatable top sleeve and the opening in the cuttings collector chamber are aligned, then the top sleeve is in the first position and cuttings can collect in the cuttings collector chamber.

5. A cuttings collector according to claim 1 wherein the cuttings collector stem, at the upper end thereof, is provided with a threaded pin, said threaded pin being configured for engagement with a drill bit.

6. A cuttings collector according to claim 1, wherein the cuttings collector further comprises a wear ring said wear ring being mountable so as to surround an upper threaded pin of the cuttings collector stem.

7. A cuttings collector according to claim 6, wherein the wear ring has a maximum outer diameter greater than a maximum outer diameter of the top sleeve and a maximum outer diameter of the cuttings collector stem.

8. A cuttings collector according to claim 1, wherein the cuttings collector further comprises one of:

a) a lower box, and b) a lower threaded pin.

9. A cuttings collector according to claim 1, wherein the cuttings collector is configured to form a replaceable part of a drill string.

10. A method for obtaining drill cuttings from subterranean wellbores, at least comprising the steps of:

a) providing a cuttings collector stem provided with a first blade and a second blade, which together form a double helix blade acting as a conveyor screw having a first transport path and a second transport path, b) providing an external wall extending between the first blade and second blade over the entire length of both blades so that an external wall of the first transport path is formed, c) providing a lower wall closing the first transport path at the lower end thereof, d) providing a top sleeve configured to be arranged at the upper end of the cuttings collector stem, said top sleeve being provided with an opening and closing arrangement, said top sleeve, in a first position, being open to the first transport path and said top sleeve, in a second position, being closed to the first transport path, said first transport path, when the top sleeve is in a closed position, forming a cuttings collector chamber being closed at the upper and lower ends thereof, e) providing one or more strainers mounted on the external wall of the cuttings collector chamber for draining liquid from cuttings collected in the cuttings collector chamber when the top sleeve is in a first position, and f) providing an internal drilling mud channel extending over the entire axial length of the cuttings collector.

* * * * *